US005556215A

United States Patent [19]

Hori

[11] Patent Number: 5,556,215

[45] Date of Patent: Sep. 17, 1996

[54] WRITING INSTRUMENT WITH OVERFLOW CHAMBER

[76] Inventor: Jiro Hori, 61-2, Kamihiroya, Tsurugashima-shi, Saitama-ken, Japan

[21] Appl. No.: 242,009

[22] Filed: May 12, 1994

[30] Foreign Application Priority Data

May 13, 1993 [JP] Japan ..... 5-111752

[51] Int. Cl.[6] ..... B43K 8/04; B43K 7/08; B43K 5/10

[52] U.S. Cl. ..... 401/199; 401/151; 401/224; 401/225; 401/230

[58] Field of Search ..... 401/151, 199, 401/223, 224, 225, 230

[56] References Cited

U.S. PATENT DOCUMENTS

| | | | |
|---|---|---|---|
| 2,921,558 | 1/1960 | Von Platen | 401/224 |
| 4,509,876 | 4/1985 | Hori | 401/151 X |
| 4,973,180 | 11/1990 | Hori | 401/151 X |
| 5,030,026 | 7/1991 | Chen | 401/151 X |

FOREIGN PATENT DOCUMENTS

| | | | |
|---|---|---|---|
| 0097474 | 1/1984 | European Pat. Off. . | |
| 0210469 | 2/1987 | European Pat. Off. . | |
| 0240994 | 10/1987 | European Pat. Off. . | |
| 515888 | 2/1955 | Italy | 401/151 |
| 44-16576 | 7/1969 | Japan . | |
| 49-2625 | 4/1972 | Japan . | |
| 62-238799 | 10/1987 | Japan . | |
| 225204 | 6/1994 | Taiwan . | |
| 1405383 | 9/1975 | United Kingdom . | |

*Primary Examiner*—Steven A. Bratlie
*Attorney, Agent, or Firm*—Jacobson, Price, Holman & Stern, PLLC

[57] ABSTRACT

A writing instrument has an ink reservoir, a nib and a feeder which temporarily stores ink which is pushed out of or pulled into the ink reservoir. The ink reservoir communicates with the nib through an ink supplying passage. The feeder chamber communicates with the atmosphere through an atmosphere communicating passage and with the ink reservoir through a capillary flow passage. The cross-sectional area of the capillary flow passage is small enough to hold ink in the capillary flow passage due to a surface tension of the ink. When the pressure in the ink reservoir due to a temperature change, etc., ink flows in the feeder chamber through the capillary flow passage or is returned from the feeder chamber to the ink reservoir. Since the feeder chamber is hollow, its volume is large and has a simple structure, the feeder can be manufactured easily. A low flow resistance of the capillary flow passage provides good response for compensation for a pressure change.

8 Claims, 12 Drawing Sheets

WRITING INSTRUMENT WITH OVERFLOW CHAMBER

BACKGROUND OF THE INVENTION

1. Field of the Invention

The present invention relates to a writing instrument including an improved feeder for controlling ink supply, and more particularly to a writing instrument provided with a hollow feeder chamber having a large capacity.

2. Description of the Related Art

In general, a writing instrument in which liquid ink is stored comprises an ink reservoir, a nib, an ink supplying passage for supplying ink from the ink reservoir to the nib, and a so-called feeder compensating for the pressure in the ink reservoir.

The feeder communicates not only with the ink reservoir but also with the atmosphere. The feeder can hold a predetermined amount of ink. When ink in the ink reservoir is expanded or shrinks by a temperature change or the like, the pressure in the ink reservoir is retained constant by pushing the ink in the feeder returning the ink from the feeder to the As the ink in the ink reservoir is being consumed, an amount of air corresponding go the consumed amount of ink is introduced from the atmosphere of the ink reservoir through the feeder to maintain a constant pressure in the ink reservoir.

As described above, the feeder is used to temporarily hold ink pushed oui of the ink reservoir and return the ink to the interior of the ink reservoir. The conventional feeder holds ink by using capillarity.

FIGS. 1 to 3 shows a writing instrument which has a writing instrument body 1 provided with a conventional feeder 6. An ink reservoir 2 is formed in the writing instrument body 1, and a nib holder 3 is provided on the front end of the writing instrument 1. A nib 4 comprising a felt tip or the like is formed on the distal end of the nib holder 3. An ink supplying passage 5 for supplying ink from the ink reservoir 2 to the nib 4 passes through the axis of the nib holder 3.

The proximal end portion of the nib holder 3 is provided with a conventional feeder 6 which comprises a large number of thin disc-like flange portions 7 and a large number of annular narrow ink holding gaps 8 formed between the adjacent flange portions 7.

The proximal end portion of the nib holder 3 in which the flange portions 7 are formed is provided with an axially continuously extending atmosphere communicating groove 9 having a front end communicating with the atmosphere. In the part of the proximal end portion of the nib holder 3 which is circumferentially separated by 180° from the atmosphere communicating groove 9 there is formed an axially continuously extending ink conducting groove 10 having a rear end communicating with the ink reservoir 2.

When the pressure in the ink reservoir 2 increases, ink is pushed out of the ink reservoir 2 into the ink holding gaps 8 through the ink conducting groove 10 and held in the ink holding gaps 8. By capillarity, the ink is moved from both sides of the ink conducting groove 10 to the ink holding gaps 8 and is filled in them successively from the inside to the outer periphery of them. Upon decrease of the pressure in the ink reservoir 2, ink is pulled into the ink reservoir 2 from the ink holding gaps 8 through the ink conducting groove 10. Ink in the ink gaps 8 that is pulled into the ink reservoir 2 is pulled by capillarity without being interrupted.

As ink in the feeder 6 is exhausted, air is introduced into the ink reservoir 2 through the atmosphere communicating groove 9, the ink holding gaps 8 and the ink conducting groove 10 to compensate for the reduction of the volume of the ink in the ink reservoir 2.

Each ink holding gap 8 is formed narrow enough to hold ink by capillarity. The width of the ink holding gap 8 is formed narrower toward the ink reservoir 2 so that the inner side of the ink holding gap 8 provides a larger capillary force than the outer side thereof. This structure enables ink from the ink reservoir 2 to fill the ink holding gap 8 from the inside to the outside thereof. The ink conducting groove 10 has a width smaller than the smallest width of the ink holding gaps 8 to provide a larger capillary force than the ink holding gaps 8 so that ink flow is prevented from being interrupted and the ink is prevented from staying in the gaps 8 when the ink is being returned to the ink reservoir 2.

However, the conventional feeder has the following disadvantages.

First, in order to meet with the recent requirement that the volume of the reservoir be enhanced, the volume of the feeder must be also increased. However, the increase of the volume of the conventional feeder is limited because the narrow ink holding gaps formed between a large number of flange portions reduce the space which can hold ink and this makes it difficult to increase the ink holding volume of the feeder.

Secondly, the feeder 6 has a large number of thin flange portions 7, and the ink conducting groove 10 has such a very narrow width as 0.1 mm. When the feeder 6 is manufactured by molding a resin material or the like, a mold is very expensive and the molding efficiency is low. Thus, a disadvantage arises in that high molding technique is required and the manufacturing cost is high when such a feeder is manufactured.

Thirdly, the width of the ink conducting groove 10 is narrow and the cross-sectional area of the flow passage is very small. The narrow ink holding gaps 8 cross the ink conducting groove 10 and make a labyrinth structure. Thus, a high resistance is produced when ink flows in the ink conducting groove 10. When, therefore, the writing instrument is turned upside down abruptly with the nib directed downward, the hydraulic pressure head in the ink reservoir 2 increases rapidly. Since, however, the resistance of the ink conducting groove 10 is large as is explained above, it takes a long time for ink to flow into the feeder 6 and compensate for the change in the hydraulic pressure head. In this condition, therefore, the change in the hydraulic pressure head cannot be compensated for in a short time. Ink supply to the nib becomes excessive and written letters or the like becomes undesirably thick at the beginning of writing.

SUMMARY OF THE INVENTION

The object of the present invention is to provide a writing instrument provided with a feeder which has a simple structure and a large ink holding volume, which is manufactured easily at a low cost, which has a good response to a pressure change and which is operated accurately to provide high reliability.

In order to achieve the object, the present invention provides a writing instrument comprising a writing instrument body, a nib provided on the writing instrument body, an ink reservoir formed in the writing instrument, for directly storing ink, an ink supplying passage formed in the writing body instrument, for supplying ink from the ink reservoir to the nib, a hollow feeder chamber formed in the writing instrument body, an atmosphere communicating passage for causing the feeder chamber to communicate with the atmosphere, and a capillary flow passage formed separately from the ink supplying passage in the writing instrument, for causing the ink reservoir to communicate with the feeder chamber.

The capillary flow passage holds ink by its capillary force. When the pressure in the ink reservoir is equal to or substantially equal to the atmospheric pressure, the ink in the ink reservoir does not flow into the feeder chamber due to the capillary force which acts as an ink holding force.

Upon pressure increase in the ink reservoir, ink flows from the ink reservoir to the feeder chamber through the capillary flow passage. Lowering of the pressure in the ink reservoir returns ink staying in the feeder chamber to the ink reservoir through the capillary flow passage. As ink returned to the ink reservoir from the feeder chamber is being exhausted by writing, air is introduced into the ink reservoir through the atmosphere communicating passage, the feeder chamber and the capillary flow passage, and a predetermined pressure is maintained in the ink reservoir.

When the hydraulic pressure head changes abruptly due to change of the posture of the writing instrument, part of ink in the ink reservoir flows into the feeder chamber thereby varying the amount of ink stored in the ink reservoir accordingly. The volume of air in the ink reservoir changes and thus the pressure in the ink reservoir is altered to compensate for the change of the hydraulic pressure head. The capillary flow passage is provided separately from the ink supplying passage. This allows the cross-sectional area of the capillary flow passage to be made larger than that of the ink supplying passage. The shape of the capillary flow passage can be made simple, and this simple structure of the capillary flow passage can reduce flow resistance. Upon rapid change of the posture of the writing instrument, ink is quickly moved from the ink reservoir to the feeder chamber and a change in the hydraulic pressure head is compensated for a good response. Therefore, the disadvantage is avoided in which writing becomes undesirably thick at the beginning of writing when the writing is carried out with the nib turned downward from another posture of the writing instrument.

In a preferred embodiment, an annular capillary flow passage is defined between the outer periphery of a partition member and the inner periphery of the writing instrument body. The width of the capillary flow passage is narrow enough to obtain a necessary capillary force on one hand, and the total cross-sectional area of the flow passage is large on the other hand.

In a further preferred embodiment, a resisting member or a valve mechanism is provided in the ink supplying passage for causing the ink reservoir to communicate with the nib. The resisting member gives a predetermined flow resistance to ink supplied from the ink reservoir to the nib so as to control the amount of ink to be supplied to the nib. The valve mechanism opens when a predetermined small pressure difference is produced between the nib and the ink reservoir, and ink is supplied to the nib stably.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The preferred embodiments of the present invention will be described with reference to the accompanying drawings.

Figure 1:
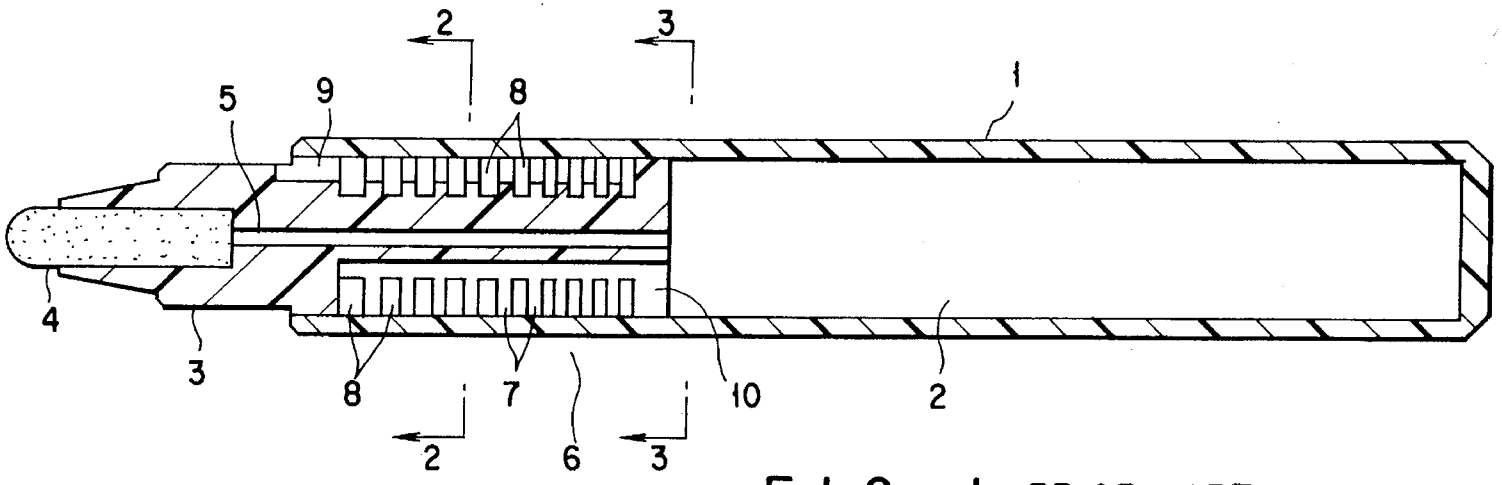
FIG. 1 PRIOR ART
FIG. 1 is a longitudinal cross-sectional view of a writing instrument provided with a conventional feeder.
Figure 2:
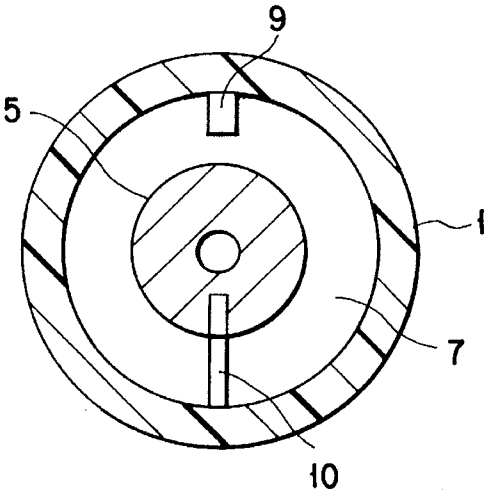
FIG. 2 PRIOR ART
FIG. 2 is a cross-sectional view along line 2—2 of FIG. 1.
Figure 3:
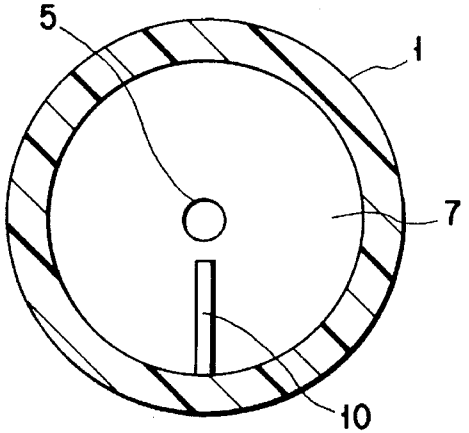
FIG. 3 PRIOR ART
FIG. 3 is a cross-sectional view along line 3—3 of FIG. 1.
Figure 4:
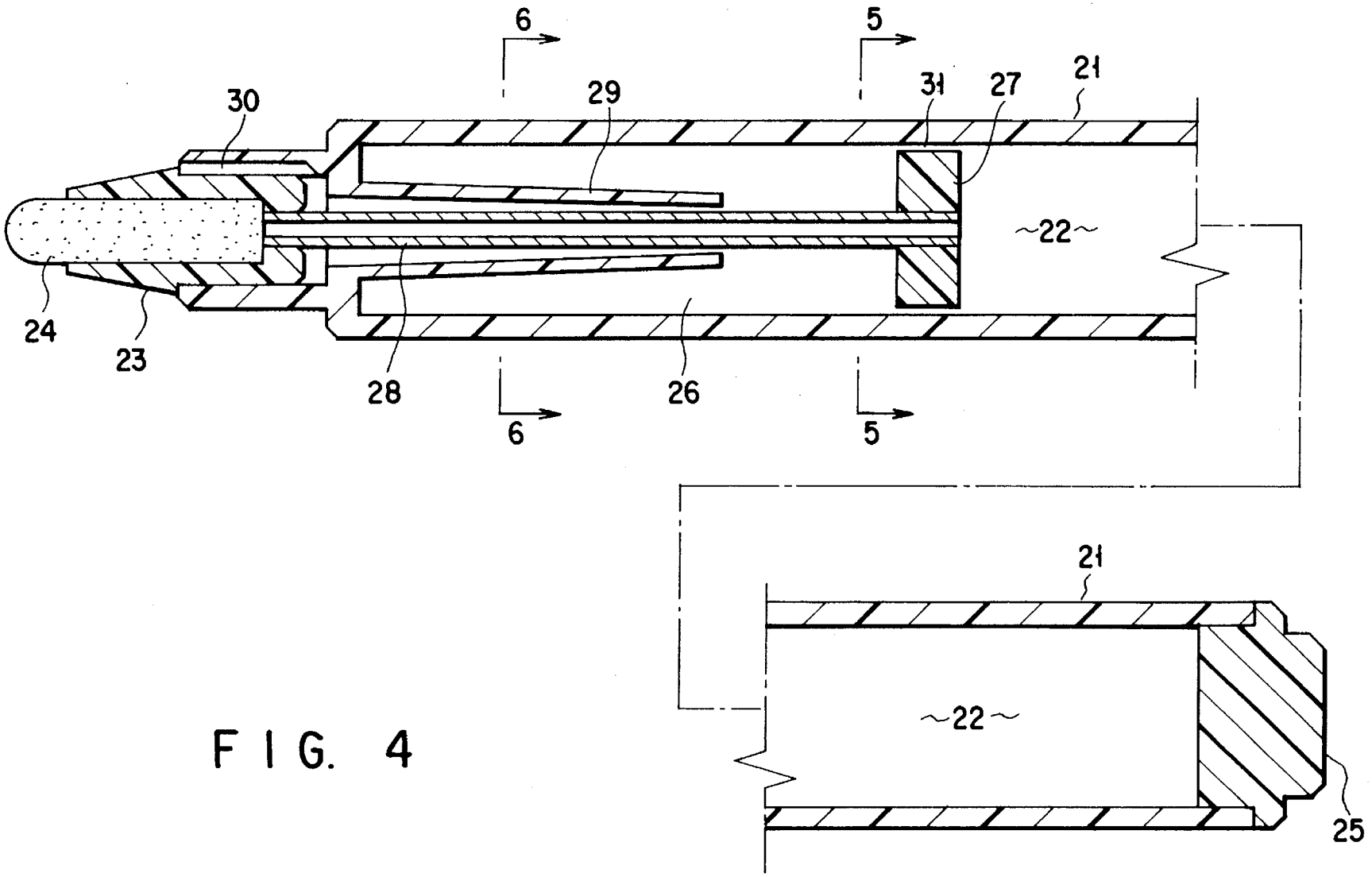
FIG. 4 is a longitudinal cross-sectional view of a first embodiment of the present invention.
Figure 5:
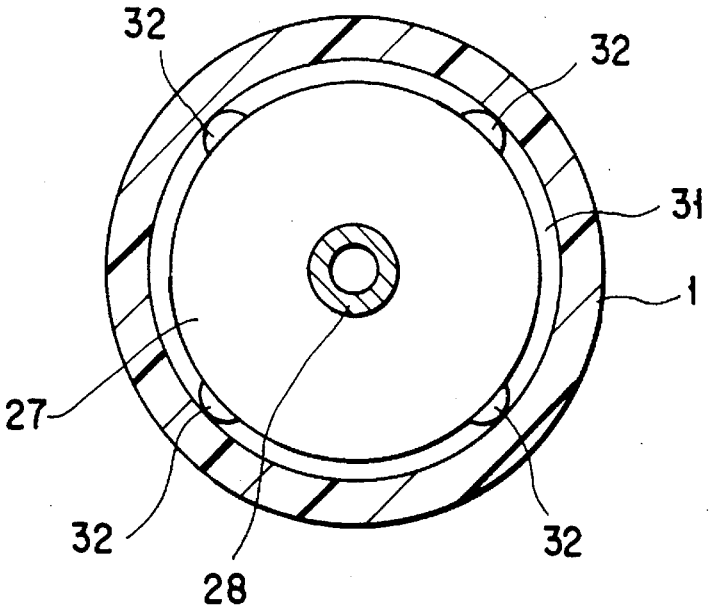
FIG. 5 is a cross-sectional view along line 5—5 of FIG. 4.
Figure 6:
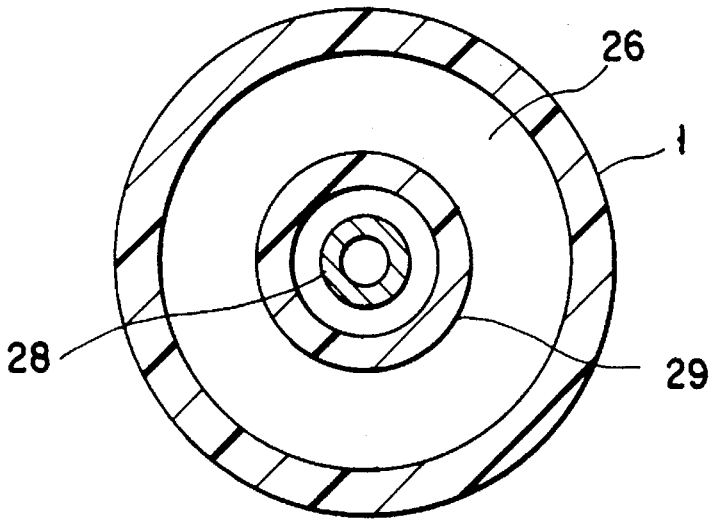
FIG. 6 is a cross-sectional view along line 6—6 of FIG. 4.

Shown in FIGS. 4 to 6 is a first embodiment of a writing instrument according to the present invention for directly storing liquid ink. A writing instrument body 21 is cylindrical, and an ink reservoir 22 is formed in the rear end portion of the writing instrument body 21. The rear end of the ink reservoir 22 is closed by an end plug 25. On the front end of the writing instrument 21 is provided a nib holder 23 which has a distal end provided with a nib 24 comprising a felt tip or the like.

A feeder chamber 26 is formed in the front portion of the writing instrument 21. A hollow cylindrical flow preventing portion 29 projects axially inward from the central portion of the front end wall of the feeder chamber 26. The front opening of the flow preventing portion 29 is disposed apart from the inner periphery of the feeder chamber 26 at its center. The interior of the flow preventing portion 29 communicates with the atmosphere through an atmosphere communicating passage 30 formed in the outer peripheral portion of the nib holder 23. Thus, the interior of the feeder chamber 26 communicates with the atmosphere, and ink staying in the interior of the feeder chamber 26 does not leak out thereof, even if the writing instrument changes its posture from a position to any other position.

A partition member 27 is provided in the writing instrument body 21 which divides the interior of the writing instrument body 21 into the ink reservoir 22 and the feeder chamber 26. The partition member 27 is made of a synthetic resin material, and it has a disc-like shape and an outer diameter slightly smaller than the inner diameter of the writing instrument body 21. A plurality of (four, example) of projections 32 are formed on the outer periphery of the partition member 27. The partition member 27 is press-fitted in the writing instrument body 21 with the outer tip portion of each projection 32 in close contact with the inner periphery of the writing instrument body 21. An annular space is formed between the outer periphery of the partition member 27 and the inner periphery of the writing instrument body 21. The annular space constitutes a capillary flow passage 31. The width of the space is set to such a value as provides a predetermined capillary force. The ink reservoir 22 communicates with the interior of the feeder chamber 26 through the capillary flow passage 31.

In the center of the feeder 26 is provided an axially extending ink supplying passage 28 formed by a metallic tube having a small diameter. The rear end portion of the ink supplying passage 28 extends through the partition member 27 and communicates with the ink reservoir 22. The front end portion of the ink supplying passage 28 is inserted in the flow preventing portion 29 and communicates with the nib 24. The cross-sectional area of the flow passage of the ink supplying passage 28 is set to a value less than 1/10 of the total cross-sectional area of the annular capillary flow passage 31.

The operation of the first embodiment will be described. Ink in the ink reservoir 22 is supplied to the nib 24 through the ink supplying passage 28. Ink is held in the capillary flow passage 31 by the capillary force. Due to the fact that the capillary flow passage forms a narrow annular space, ink is uniformly held by the capillary force in the capillary flow passage over its whole circumference. The capillary flow passage 31 is sealed by the capillary force of the ink. When the pressure in the ink reservoir 22 is equal to or substantially equal to the atmospheric pressure, the ink does not flow into the feeder chamber 26.

As air in the ink reservoir 22 is expanded due to temperature rise and the like and the pressure in the ink reservoir 22 increases, ink flows from the ink reservoir 22 into the feeder chamber 26 through the capillary flow passage 31, and the pressure increase in the ink reservoir 22 is compensated to maintain the pressure therein constant. When the pressure in the ink reservoir 22 is lowered by contraction of air in the ink reservoir 22 due to lowering of the temperature and the like, the ink staying in the feeder chamber 26 is returned to the ink reservoir 22 through the capillary flow passage 31. Thus, the lowering of the temperature in the ink reservoir 22 is compensated and the pressure therein is maintained constant.

Since the feeder chamber 26 is hollow and flange portions or the like do not exist therein, it has a large volume and so it can store and hold a large amount of ink. The opening at the front end of the flow preventing portion 29 is provided at the center of the feeder chamber 26 apart from the inner periphery of the feeder chamber 26. In this arrangement, the upper surface of ink does not arrive at the front opening of the flow preventing portion 29, as long as ink is accumulated so as to exceed the level of the axial central line of the writing instrument. Thus, ink in the feeder chamber 26 does not leak out even if the posture of the writing instrument is changed in any way.

In the first embodiment, the capillary flow passage 31 has a narrow annular space. Thus, even if the width is small enough to obtain a predetermined capillary force, the total cross-sectional area of the flow passage can be made large. In this regard, the cross-sectional area of the capillary flow passage 31 can easily be set to a value more than ten times larger than the cross-sectional area of the ink supplying passage 28. The capillary flow passage 31 is short and simple. Thus, ink receives a low resistance when ink flows in the capillary flow passage 31, and ink flows quickly between the ink reservoir 22 and the feeder 26 when the pressure in the ink reservoir 22 varies so that high response to compensation for pressure change of ink in the ink reservoir 22 can be attained. Where the hydraulic pressure head of ink in the ink reservoir 22 is abruptly altered by the rapid change of the posture of the writing instrument so as to direct the nib 24 downward for writing, the ink moves quickly from the ink reservoir 22 into the feeder chamber 26 to quickly compensate for the pressure change This structure prevents ink from being supplied excessively to the nib, and writing at its beginning does not become undesirably thick.

Figure 7:
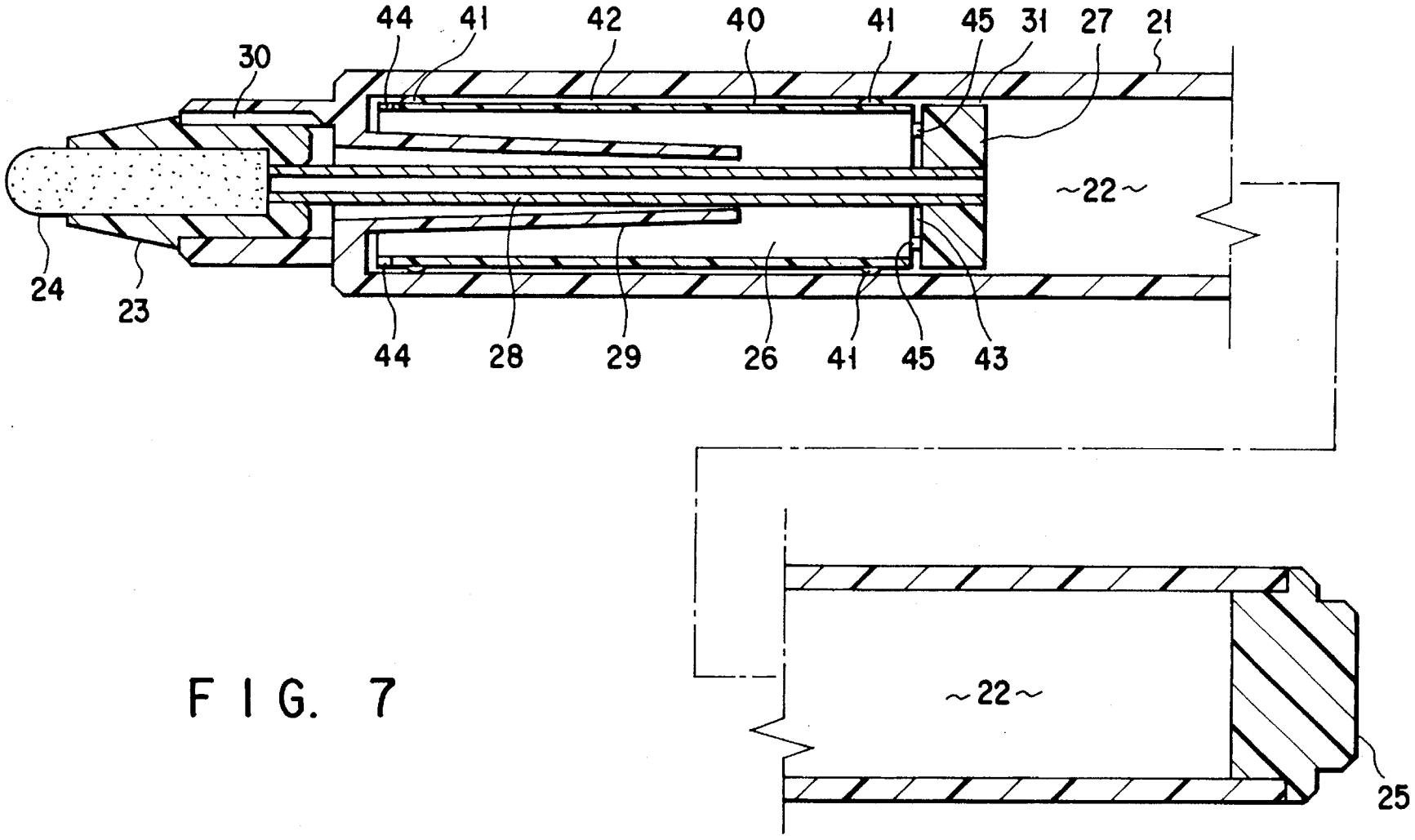
FIG. 7 is a longitudinal cross-sectional view of a second embodiment of a writing instrument according to the present invention.

The present invention is not limited to the first invention. For example, FIG. 7 shows a second embodiment in which a capillary return passage 42 is provided in a feeder chamber 26 so as to extend along its inner periphery. In other words, a return passage tube 40 is housed in the feeder chamber 26. The return passage tube 40 is hollow cylindrical and has a thin thickness. Its outer diameter is slightly smaller than the inner diameter of the feeder chamber 26. A plurality of projections 41 are formed on the outer periphery of its both end portions. The return passage tube 40 is press-fitted in the feeder chamber 26 with the projections 41 in contact with the inner periphery of the feeder chamber 26. Between the outer periphery of the return passage tube 40 and the inner periphery of the feeder chamber 26 is formed a narrow annular space which provides a predetermined capillary force. The space constitutes the capillary return passage 42.

Between a partition member 27 and the end face of the return passage tube 40 at the side of an ink reservoir 22 is formed a narrow ring-shaped space in the order of 0.1 mm. The space constitutes a return communicating passage 43. A plurality of projections 45 for maintaining a predetermined width of the return communicating passage 43 extend from the rear end face of the return passage tube 40. In the front end of the return passage tube 40 are formed a plurality of notches 44 which reduce a resistance due to a capillary force when ink flows from the capillary return passage 42 to the feeder chamber 26.

In the second embodiment, ink is held both in the capillary return passage 42 and in the return communicating passage 43 by capillary forces. Thus, the capillary return passage 42 substantially communicates with the capillary flow passage 31. When the writing instrument takes a posture with the nib directed downward and the pressure in the ink reservoir 22 is reduced, ink in the feeder chamber 26 flows from the front end of the return passage tube 40 into the capillary return passage 42 and is returned to the ink reservoir 22 through the capillary flow passage 31. When the writing instrument takes a posture with the nib directed upward, ink flows from the feeder chamber 26 into the capillary flow passage 31 through the return communicating passage 43 and is returned to the ink reservoir 22. Thus, ink does not stay in the feeder chamber 26 but is returned to the ink reservoir 22 even if the writing instrument of the second embodiment takes any posture.

In the second embodiment, the capillary flow passage 31 substantially communicates with the capillary return passage 42. The capillary return passage 42 extends to the front end of the feeder chamber 26 and has a length substantially equal to the length of the ink supplying passage 28. When writing is carried out with the nib directed downward, the pressure in the ink reservoir 22 is lowered by the hydraulic pressure head corresponding to the length of the capillary return passage 42. The amount of the reduced pressure is substantially equal to the hydraulic pressure head of ink which corresponds to the length of the ink supplying passage 28. The hydraulic pressure head of ink corresponding to the length of the ink supplying passage 28 is canceled out so that the ink pressure applied to the nib 24 is made constant and ink supply is much stabilized. The structure and operation of the second embodiment is the same as those of the first embodiment except for the above-mentioned structure and operation.

Figure 8:
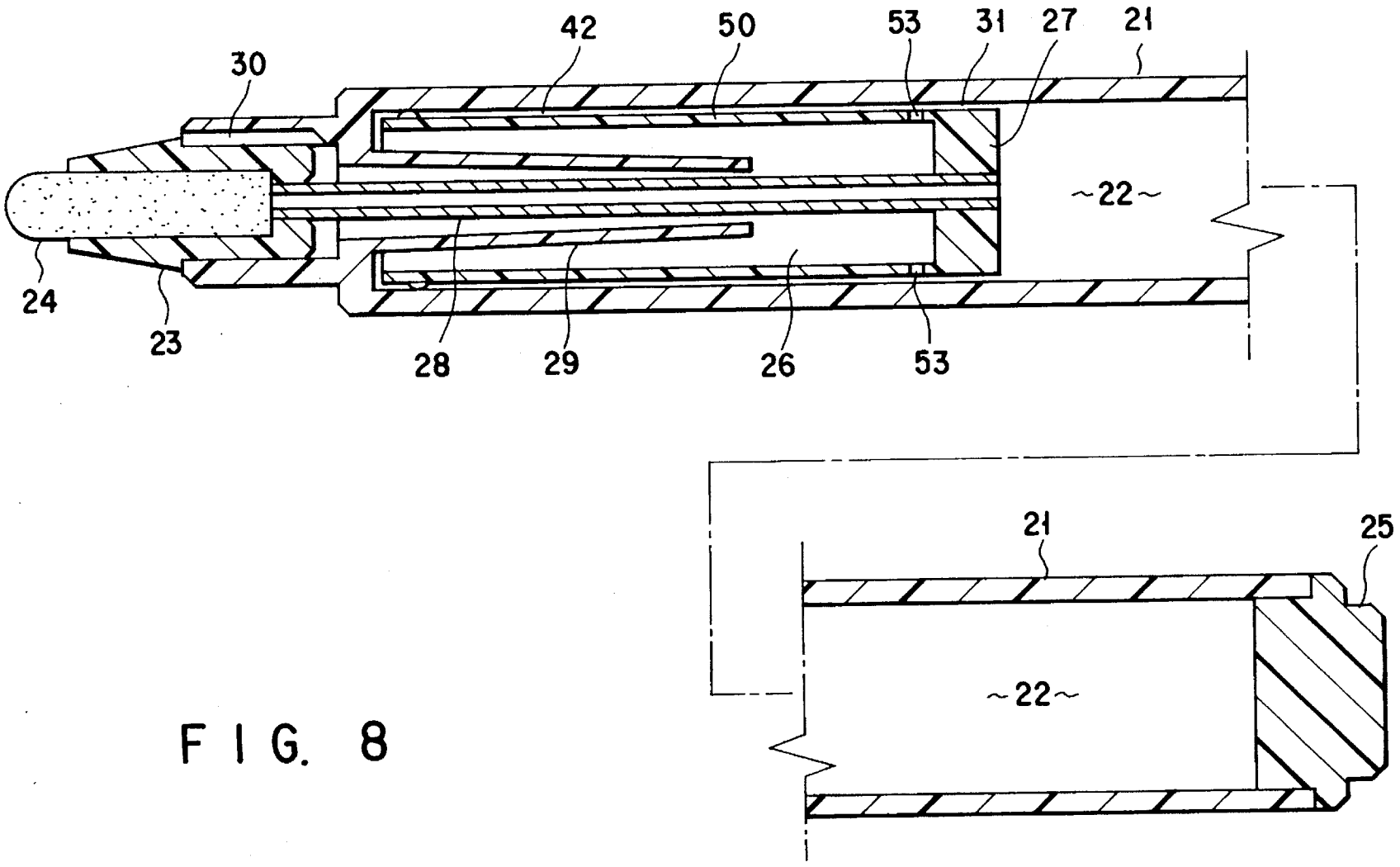
FIG. 8 is a longitudinal cross-sectional view of a third embodiment of a writing instrument according to the present invention.

In FIG. 8 is shown a third embodiment of the present invention in which a return passage tube 50 similar to that of the second embodiment is formed integral with a partition member 27. A small-diameter return communicating hole 53 providing a capillary force is formed in the proximal end portion of the return passage tube 50 in place of the annular return communicating groove of the second embodiment. The structure of the third embodiment is the same as those of the first and second embodiments except for the structure of the return communicating hole 53.

Figure 9:
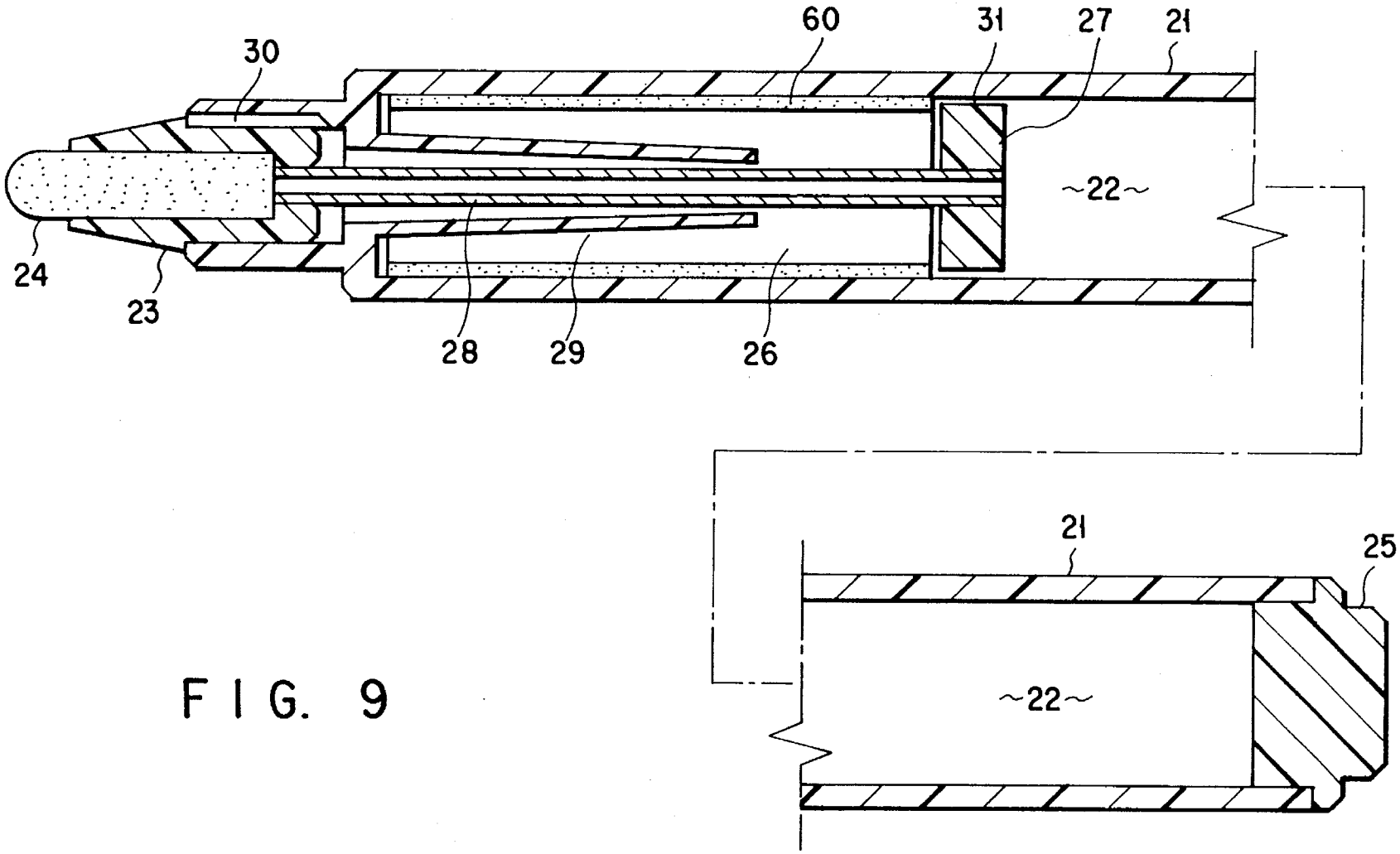
FIG. 9 is a longitudinal cross-sectional view of a fourth embodiment of a writing instrument according to the present invention.

In FIG. 9 is shown a fourth embodiment of the present invention in which a cylindrical capillary return member 60 made of a porous material such as felt and acting as a capillary return passage is provided in a feeder chamber 26. Except for it, the structure of the fourth embodiment is the same as those of the first and second embodiments.

Figure 10:
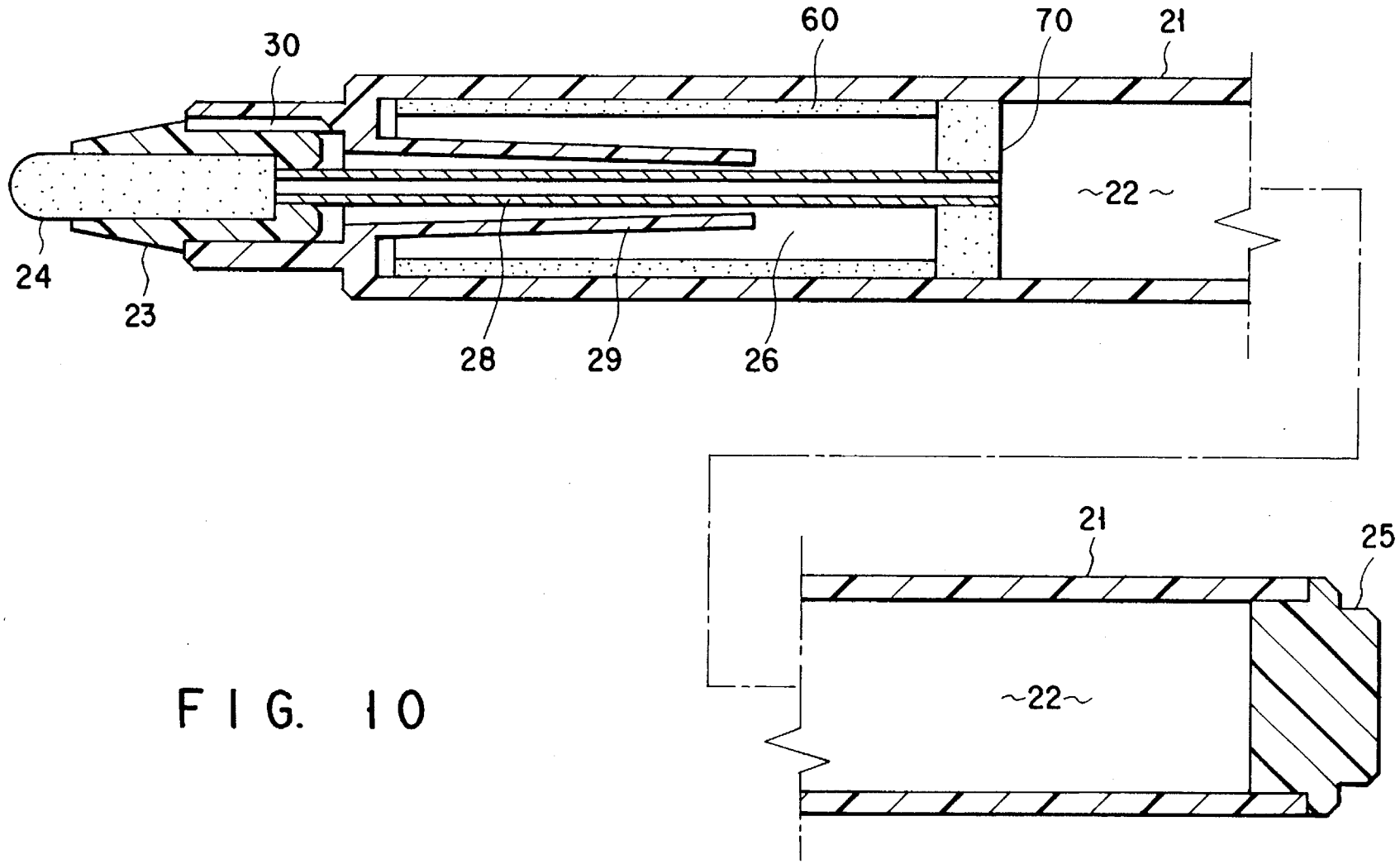
FIG. 10 is a longitudinal cross-sectional view of a fifth embodiment of a writing instrument according to the present invention.

FIG. 10 shows a fifth embodiment of the present invention. A capillary partition member 70 made of a porous material such as felt is used in place of the partition member of any one of the first to third embodiments and is fitted in a writing instrument body 21. Ink is held in the capillary partition member 70 by a capillary force. In the fifth embodiment, a capillary flow passage comprising an annular space like the first to fourth embodiments is not formed. The other structure of the fifth embodiment is the same as that of the fourth embodiment.

Figure 11:
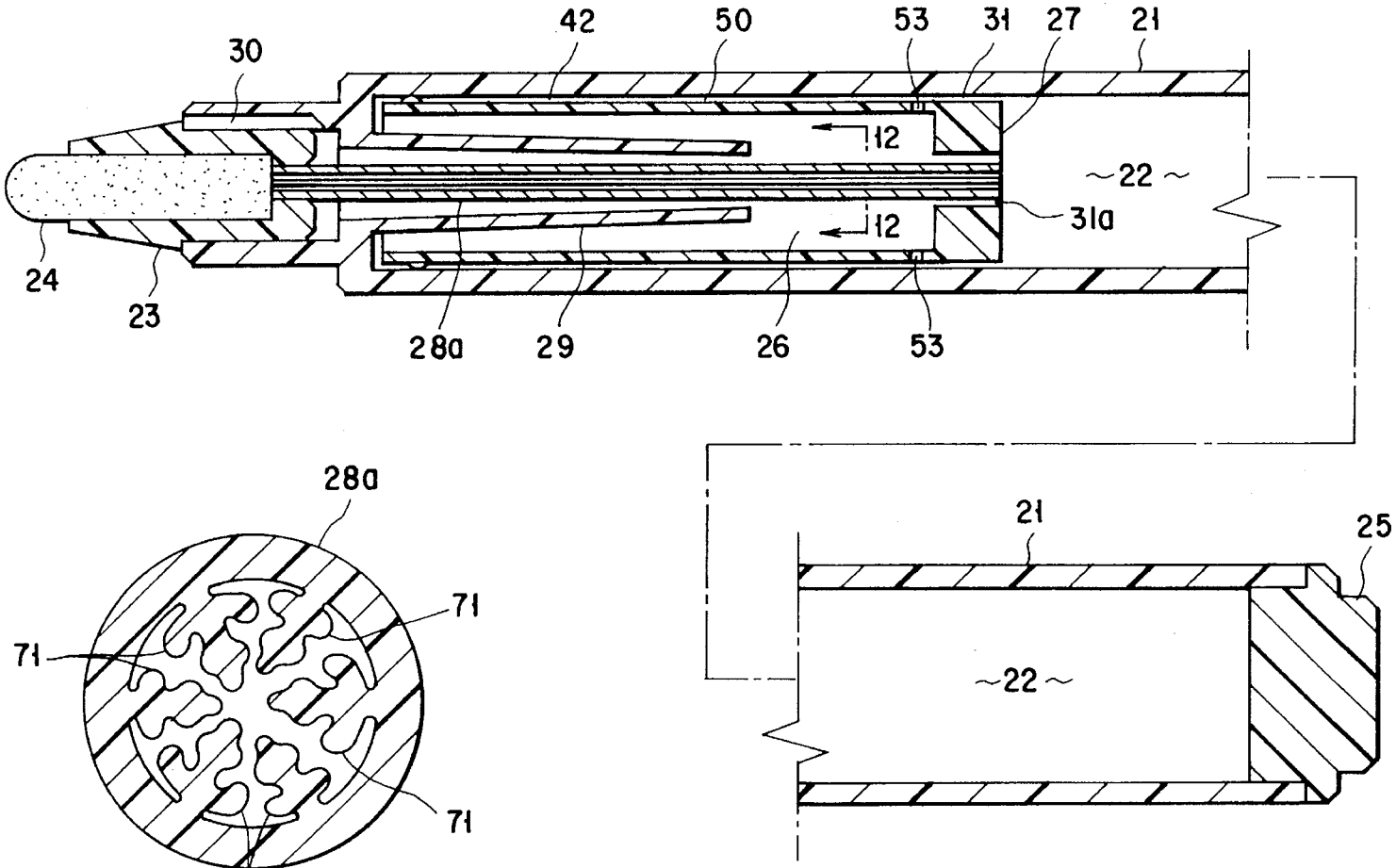
FIG. 11 is a longitudinal cross-sectional view of a sixth embodiment of a writing instrument according to the present invention.
Figure 12:
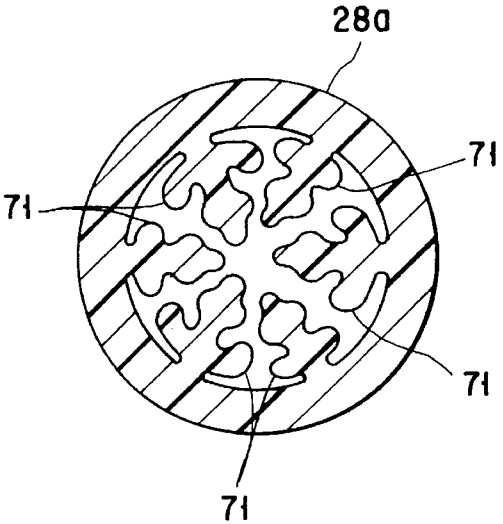
FIG. 12 is a cross-sectional view along line 12—12 of FIG. 11.

FIGS. 11 and 12 show a sixth embodiment of the present invention. This embodiment is fundamentally the same as the third embodiment shown in FIG. 8, but difference exists in that a second annular capillary passage 31*a* is formed between the outer periphery of the front portion of an ink supplying passage 28a and a partition member 27. From the inner periphery of the ink supplying passage 28*a* inwardly extend a plurality of fine projections 71 each having a tree branch shape so that a flow passage having a complicated cross section is defined by the projections 71 in the ink supplying passage 28*a* as shown in FIG. 12. When flowing in the ink supplying passage 28*a*, ink is given a predetermined flow resistance by the ink supplying passage 28*a*. Thus, the maximum flow amount of ink supplied from the ink reservoir 22 to the nib 24 is limited, and the amount of ink supplied to the nib 24 can be controlled stably.

Figure 13:
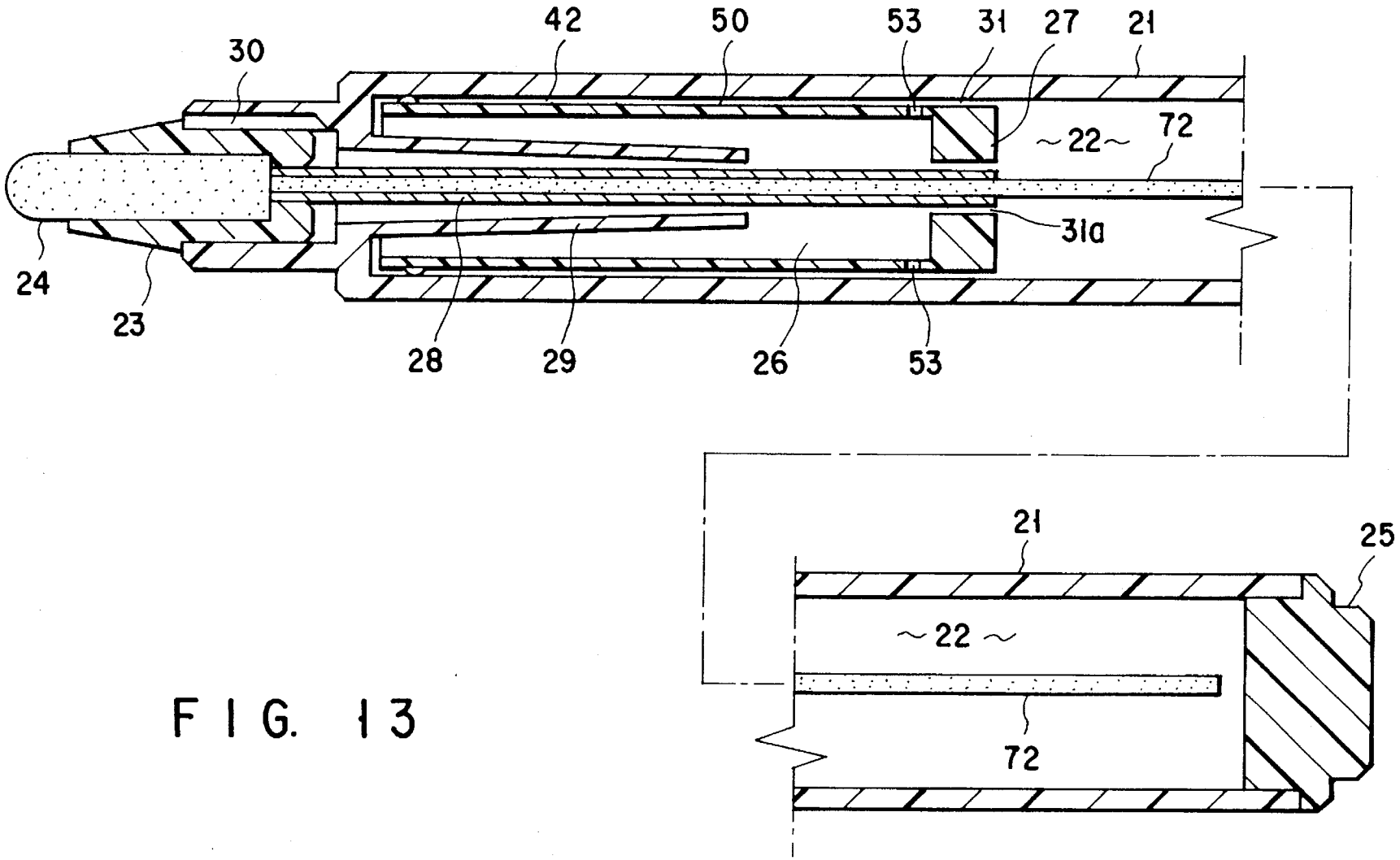
FIG. 13 is a longitudinal cross-sectional view of a seventh embodiment of a writing instrument according to the present invention.

FIG. 13 shows a seventh embodiment which is fundamentally the same as the third embodiment. It differs from the third embodiment in that a tubular capillary rod 72 made of a porous material such as a bundle of fiber is inserted in an tubular ink supplying passage 28. The tubular capillary rod 72 extends through an ink reservoir 22, and the rear end of the tubular capillary rod 72 reaches the rear end of the ink reservoir 22. The seventh embodiment is suited for a white marker whose nib 24 is a felt tip. Since white marks are applied with a white marker on a white board placed usually substantially vertically, the white marker is used horizontally or with the nib directed slightly upward in most cases. In these cases, ink in the ink reservoir 22 stays in the rear end portion of the ink reservoir 22 in the conventional white marker. In this embodiment, however, the capillary rod 72 extends to the rear end of the ink reservoir 22, whereby ink can be sucked by a capillary force and supplied to the nib.

When the white marker is used with the nib directed downward, the tubular capillary rod 72 gives a large flow resistance to ink flowing in the ink supplying passage 28. Thus, the amount of ink supplied to the nib 24 can be controlled like in the case of the seventh embodiment.

Figure 14:
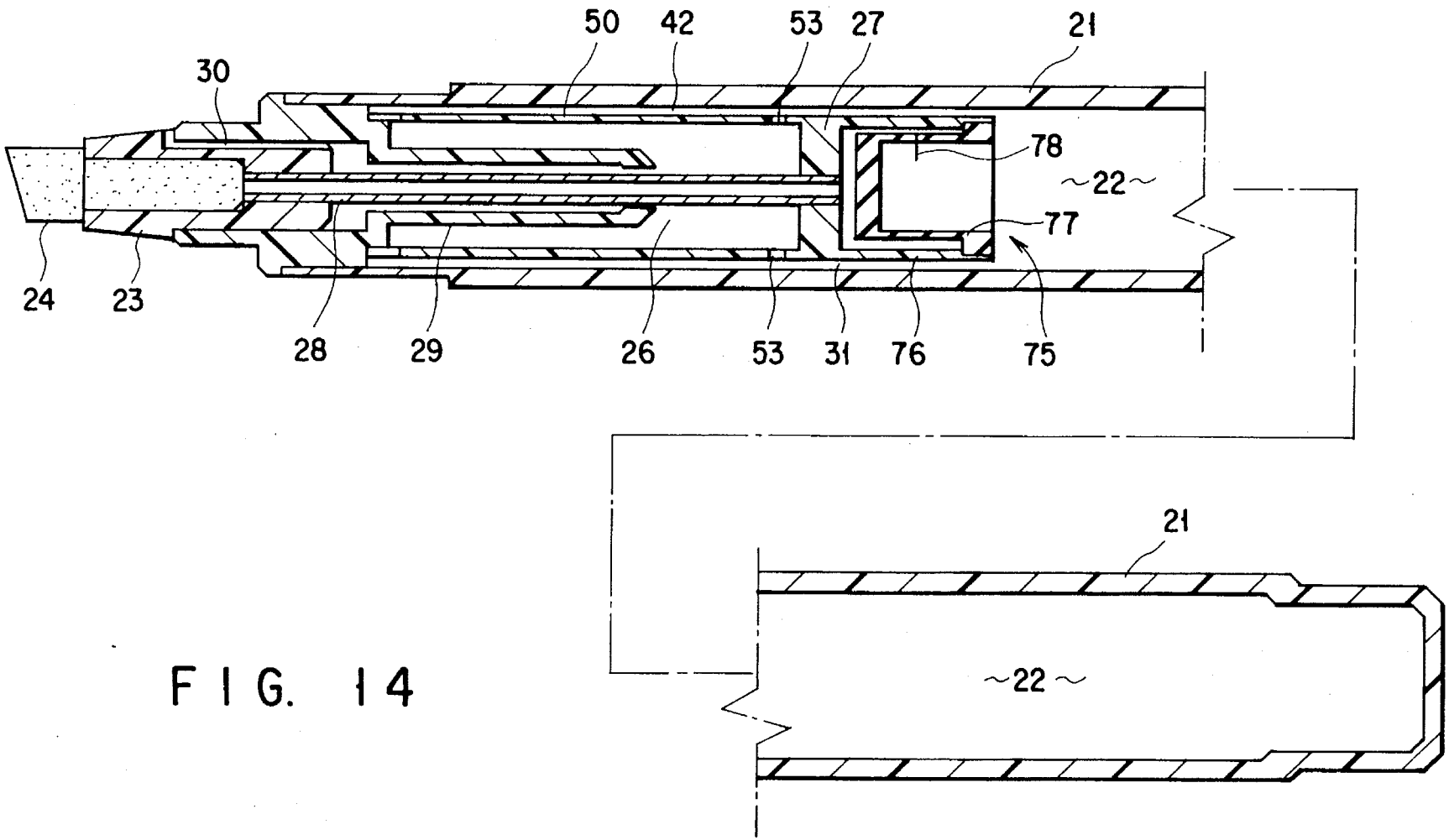
FIG. 14 is a longitudinal cross-sectional view of an eighth embodiment of a writing instrument according to the present invention.

FIG. 14 shows an eighth embodiment which is fundamentally the same as the third embodiment as shown in FIG. 8. The difference exists in that a valve mechanism 75 is provided in an ink supplying passage 28 for causing an ink reservoir 22 to communicate with a nib 24. A tubular holder portion 76 extends from the rear end of a partition member 27, and a cup-shaped valve body 77 made of synthetic rubber or the like material is provided in the holder portion 76, for interrupting communication between the ink reservoir 22 and the nib 24. A circumferentially extending cut groove 78 is formed in part of the peripheral wall of the cup-shaped valve body 77. The cut groove 78 is closed by an elastic force of the rubber valve body 77 in a not-operated state. When, however, ink included in the nib 24 is exhausted when the writing instrument is in operation, the pressure in the nib 24 becomes lower than that in the ink reservoir 22, and pressure difference between the nib 24 and the ink reservoir 22 deforms the cup-shaped valve body 77 to open the cut groove 78. Thus, ink is supplied from the ink reservoir 22 to the nib 24 through the cut groove 78. The valve mechanism 75 opens and ink is supplied only when a predetermined small pressure difference is generated between the nib and the ink reservoir upon exhaust of ink contained in the nib by writing. Therefore, the amount of ink supplied to the nib 24 is stabilized and the thickness of writing can always be maintained constant.

Figure 15:
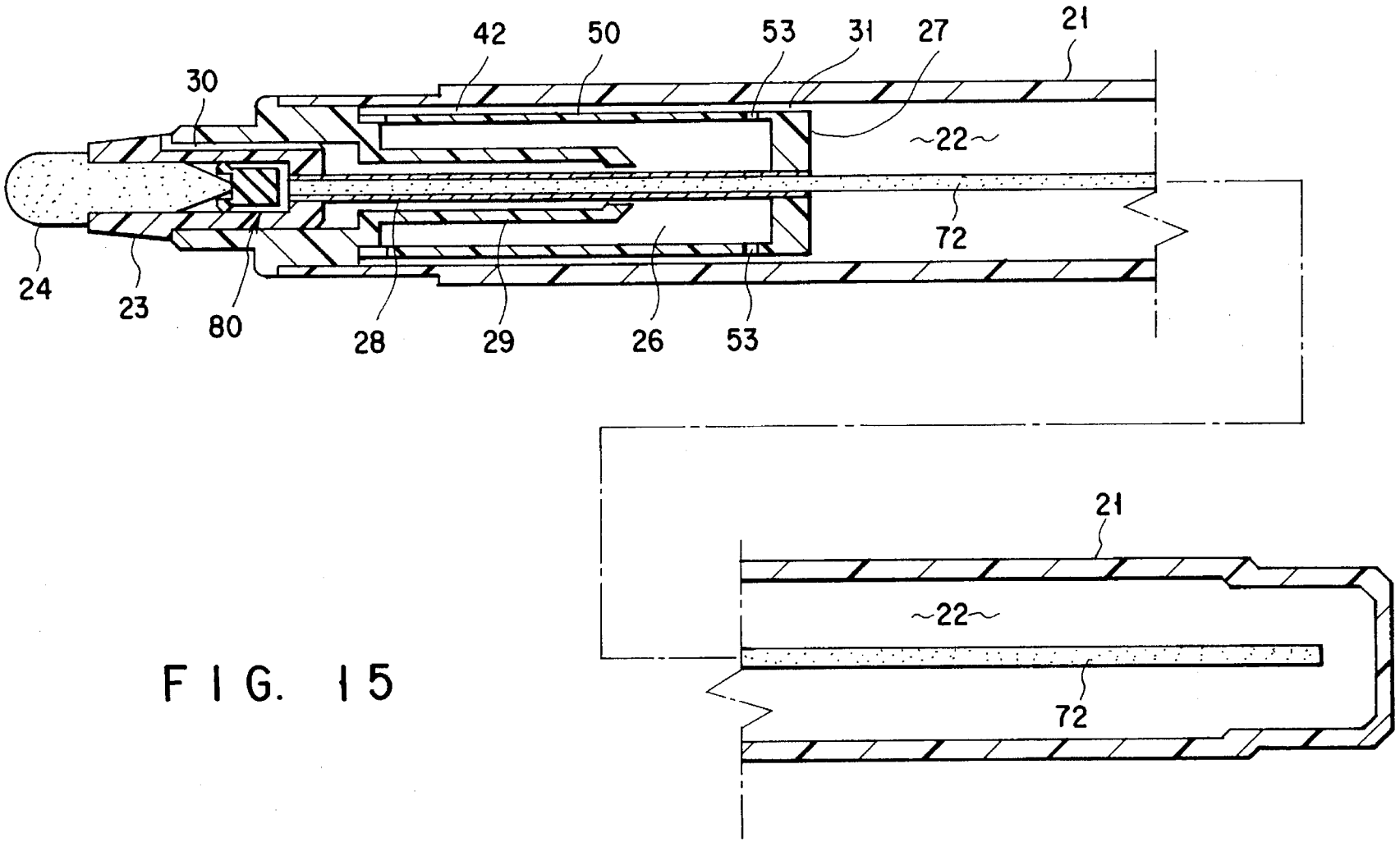
FIG. 15 is a longitudinal cross-sectional view of a ninth embodiment of a writing instrument according to the present invention.
Figure 16:
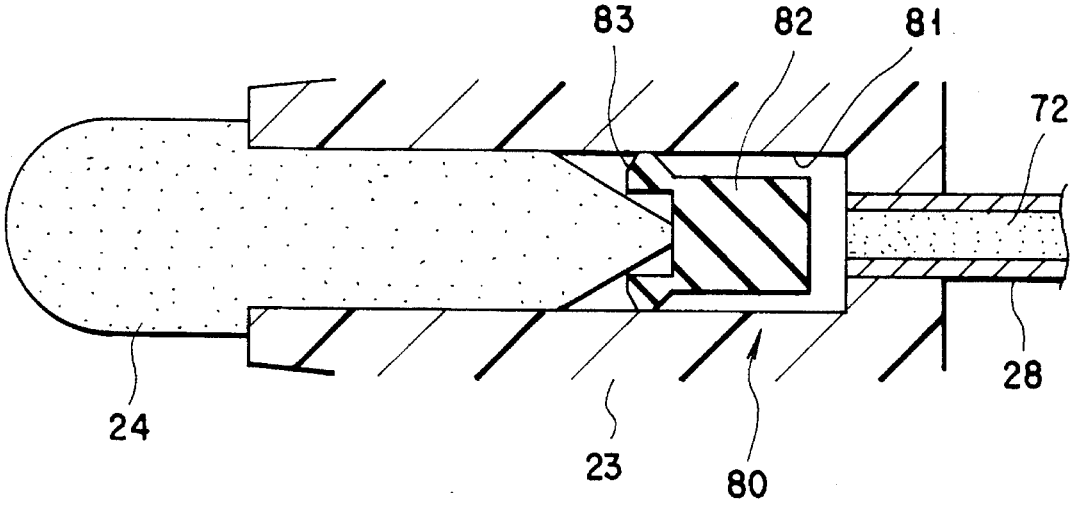
FIG. 16 is an enlarged longitudinal cross-sectional view of a nib and valve mechanism of FIG. 15.

FIGS. 15 and 16 show a ninth embodiment of the present invention which is provided with a valve mechanism 80 having the similar function as the valve mechanism 75 of the eighth embodiment as shown in FIG. 14, and a capillary rod 72 as shown in FIG. 13. The capillary rod 72 extends to the rear end of an ink reservoir 22, and the valve mechanism 80 is housed in a nib holder 23. As shown in FIG. 16, a valve housing portion 81 is formed in the nib holder 23, and a plug-shaped valve body 82 made of an elastic material such as synthetic rubber is inserted in the valve housing portion 81 so as to interrupt communication between the nib 24 and the ink supplying passage 28 (i.e., the ink reservoir 22). A lip portion 83 is formed integral with the valve body 83 and extends radially outward from its outer periphery. The lip portion 83 is in a light contact with the inner periphery of the valve housing portion 81 in a liquid-tight state. The nib 24 (the rear end of a felt tip, for example) abuts against the front end of the plug-shaped valve body 82 so as to prevent movement of the valve body 82.

Only when ink included in the nib is exhausted in the ninth embodiment and a small pressure difference is generated between the nib 24 and the ink reservoir 22, the lip portion 83 is deformed, and a controlled amount of ink is supplied to the nib 24 as is the case in the eighth embodiment.

The present invention is not limited to the above-mentioned embodiments. For example, the nib is not limited to a felt tip nib but may be made of any other material. The structure of the capillary passage is not limited to any of the above-mentioned ones but may be the one which provides a necessary flow cross-sectional area.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A writing instrument comprising:

a writing instrument body having a front end;

a nib provided on said front end of said writing instrument body;

an ink reservoir formed in said writing instrument body, for storing ink;

an ink supplying passage for supplying ink from said ink reservoir to said nib;

a hollow feeder chamber formed in said writing instrument;

an atmosphere communicating passage for causing said feeder chamber to communicate with the atmosphere; and a capillary flow passage formed separately from said ink supplying passage, for causing said ink reservoir to communicate with said feeder chamber, said capillary flow passage having such a small cross-sectional area as to hold said ink in said capillary flow passage due to a surface tension of said ink, said writing instrument body having an interior and an inner periphery, a partition member which has an outer periphery dividing said interior of said writing instrument into said ink reservoir and said feeder chamber, said capillary flow passage comprising an annular space formed between said inner periphery of said writing instrument and said outer periphery of said partition member.

2. A writing instrument according to claim 1, wherein said feeder chamber has a central portion and a hollow flow preventing portion extending axially from said central portion of said feeder chamber, said flow preventing portion having a distal end opened to said feeder chamber and a proximal end communicating with the atmosphere, said flow preventing portion forming part of said atmosphere communicating passage, and said ink supplying passage comprises a tube having a small diameter and axially inserted in said flow preventing portion.

3. A writing instrument according to claim 1, wherein said feeder chamber has an inner periphery, said feeder chamber housing a cylindrical return passage tube having an outer periphery, and said inner periphery of said feeder chamber and said outer periphery of said return passage tube defining therebetween a small space which constitutes said capillary return passage.

4. A writing instrument according to claim 3, wherein said return passage tube is formed integral with said partition member.

5. A writing instrument according to claim 3 wherein said ink supplying passage includes a capillary rod extending beyond the partition member to an area of said ink reservoir remote from said partition member.

6. A writing instrument according to claim 3 wherein said cylindrical return passage tube engages said partition member, said cylindrical return passage tube including small diameter return holes adjacent the partition member to provide a capillary force in the cylindrical return passage tube proximal said partition member.

7. A writing instrument according to claim 1, wherein said ink supplying passage for causing said ink reservoir to communicate with said nib gives a flow resistance to ink flowing in said ink supplying passage.

8. A writing instrument according to claim 1 wherein said ink supplying passage includes a capillary rod extending beyond the partition member to an area of said ink reservoir remote from said partition member.

* * * * *